United States Patent [19]

Morell et al.

[11] Patent Number: 4,653,204

[45] Date of Patent: Mar. 31, 1987

[54] SKI BOOT

[75] Inventors: Joseph Morell, Annecy; Louis Benoit, Frangy; Maurice Bonnet, Rumilly, all of France

[73] Assignee: Salomon S. A., Annecy, France

[21] Appl. No.: 793,035

[22] Filed: Oct. 30, 1985

[51] Int. Cl.[4] ..... A43B 5/04; A43B 11/00; A43C 11/00

[52] U.S. Cl. ..... 36/117; 36/50; 24/68 SK; 24/71.1

[58] Field of Search ..... 36/117–121, 36/50; 24/68 SK, 69 SK, 70 SK, 71 SK, 71.2, 24/71.1

[56] References Cited

U.S. PATENT DOCUMENTS

| | | | |
|---|---|---|---|
| 4,433,456 | 2/1984 | Baggio | 36/50 X |
| 4,574,500 | 3/1986 | Aldinio et al. | 36/119 |

FOREIGN PATENT DOCUMENTS

| | | | |
|---|---|---|---|
| 0053340 | 6/1982 | European Pat. Off. | 36/120 |
| 2900077 | 7/1980 | Fed. Rep. of Germany | 36/50 |
| 3342121 | 6/1984 | Fed. Rep. of Germany | 36/117 |
| 3502522 | 8/1985 | Fed. Rep. of Germany | 36/117 |

*Primary Examiner*—James Kee Chi

*Attorney, Agent, or Firm*—Pollock, Vande Sande & Priddy

[57] ABSTRACT

Winding device for adjusting the length and tension of the braces on a rear entry ski boot for tightening the skier's foot and closing the boot shank on the skier's leg. The device comprises a control button turnably mounted on the boot and having an axle offset with respect to its rotation axis, a toothed pinion turnably mounted on the offset axle, and a toothed ring coaxial with the control button and having one tooth more than the pinion. The pinion turns inside the ring. The braces cooperate with winding grooves via anchoring devices carried by the pinion and ring, respectively.

9 Claims, 9 Drawing Figures

SKI BOOT

FIELD OF THE INVENTION

The present invention pertains to ski boots equipped with devices for adjusting the length and tension of the braces intended to ensure, for example, the tightening of the foot in said boots and simultaneously the closing of the shank thereof on the base of the skier's leg, in particular in rigid shell-type ski boots with rear foot entry.

BACKGROUND OF THE INVENTION

Certain known ski boots of this type generally have a rigid shell base topped by a shank made of two parts, a collar and 2 spoiler, at least one of the two parts being movable with respect to the other to allow the introduction of the skier's foot when the boot is being put on. For these boots, the closing of the boot on the foot and the skier's leg is most often achieved by bringing the spoiler towards the collar through the use of a tension application device comprised of at least one flexible brace under the control of a foot support system and a leg base support system. In these boots, due to the use of at least one flexible brace, the active length of this flexible brace is determinative for the stresses of closing and tightening, and it is thus necessary to connect to the tension application device a means of adjusting said active length of the brace.

As an example, known boots of this type are described in European Patent Application No. 0053340; they comprise a system for supporting the foot and a system for supporting the base of the leg, which are each controlled by a single tension application device through the intermediary of a flexible brace, one part of which is connected in a position-controllable manner on said device; thus, by changing the position of said part of one or both of the braces on the corresponding tension application device, the active length of these and thus their tension is equally modified. As will be noted, each tension application device thus allows adjustment of the length of the flexible brace which is dependent on it and the tension applied to the corresponding support system. This differentiation is desirable because the support of the base of the leg must be relatively more firm than the support on the foot. However, separating the controls for support of the foot and of the base of the leg makes the closing and adjustment of the boot inconvenient and complex to execute; actually, it is necessary to successively adjust the length of one brace, then the other, by trial and error, by placing the respective tension application devices in unlocked position, then by bringing them back into locked position to control the tension stress resulting from the adjustment made.

Other boots are equipped with tension application devices comprised of winders, allowing, in a single maneuver, the modification of the active length of a brace and its tension. These devices are in the form of a spool, whose rotating movement is effected by action on an external reel.

Due to the relatively small size of these spools, which must be associated with the boots, the rotation stress which can be applied manually is incompatible with that of the tension to be obtained on the brace for an optimum support of the foot, in particular, with regard to women and children.

Thus, certain manufacturers have planned to provide such winding devices with a spool equipped with a step-down wheel gear. With such an assembly, a certain number of rotations of the spool must occur to wind up a relatively small portion of the brace. Thus, to arrive at bringing the spoiler and the collar together with such a device, when the boot is put on, it is necessary to execute a great number of rotations, with the consequent length of brace to wind up.

In another instance, for this type of boot, two braces have been provided which could be coupled on the spool whose rotating movement then causes the winding or unwinding of the two braces simultaneously and in the same lengths. Such winding devices also turned out to be unsuitable for the single controls for tightening of the braces which control at once the internal foot bracing system and the leg support system. In fact, in this case, the winding of the braces and their tension are not differentiated according to each of the said support systems.

However, the leg base support system in particular requires a high degree of availability of the length of the brace, to allow the relative distancing of the spoiler from the collar and thus to allow the boot to be put on, contrary to the foot support system.

OBJECT OF THE INVENTION

The present invention is proposed to overcome these disadvantages through the use of a winding device, designed to accomodate two flexible braces, said winding device allowing, on one hand, the differentiated winding of the two separate lines and, on the other hand, the automatic balancing of the lengths of one brace with respect to the other through the release of a certain length of the tighter flexible brace and through the winding of an equivalent length of the looser brace, while ensuring different exit tensions between said braces.

SUMMARY OF THE INVENTION

According to the invention, the winding device comprises:

- a control button turnably mounted on a part of the boot, said button being provided with an axle which is offset with respect to its rotation axis;
- a toothed pinion, turnably mounted on the offset axle of the button, and equipped with a means of engagement of one end of a brace as well as a supporting surface for the axis on which said brace can be wound; and
- a toothed ring which is coaxial with the control button, turnably mounted in a housing installed on said part of the boot, said ring being equipped with a number of teeth which is greater by one than that of the pinion.

The latter engages with the ring by rolling, when the offset axis is moved in rotation through the use of the button. On the other hand, the ring has a means of engaging an end of the brace other than the brace which is attached to the pinion as well as a reel on which said brace can be wound.

Such a winding device operates in the same manner as a reducer; thus, by turning the control button, the off-center device is pulled, which requires the pinion to roll inside of the ring. The ring being equipped with a number to teeth greater by one than that of the pinion, the result, for an off-center turn, is a lag of one tooth of said pinion with respect to the ring. This lag, which in fact translates into a certain rotation of the pinion in itself, causes the winding of the brace attached to said pinion, by a quantity equal to the length of the arc corresponding to the angular value between two pinion teeth. As soon as the pinion brace undergoes a certain tension which resists its winding more than the resistance of the second brace attached to the ring as well as the friction from the components put into operation, said pinion pushes the toothed ring back by an angular distance substantially equal to that of one tooth. This causes the winding of the second brace on the ring until a new equilibrium of the forces at the level of the pinion and the ring. As soon as the ring is attained offers resistance which is greater than that of the pinion under the effect of tension from the second brace with which it cooperates, the pinion will again roll inside this ring, while pulling on said pinion brace. Thus, both of the braces are wound successively and alternatively as a function of their respective tensions.

According to a preferred embodiment of the invention, the winding device is associated with and carried by a tension lever which is articulated on the spoiler of the ski boot between an unlocked position which releases a certain length of the braces of the foot support system and the leg base support system, and a stable, locked position allowing said braces to be maintained under tension through the use of a toggle joint system.

In this embodiment, the winding device can be utilized only to ensure the pre-setting of the active length of the braces, while the tension device ensures the application of tension to them, which, in particular, causes the spoiler to move towards the collar on the base of the leg.

Advantageously, the adaptation of the boot to the skier's foot is effected while the tension device is in locked position; to do this, the winding device is moved in the direction corresponding to the increase or decrease in the tension of the braces until the desired stresses for the support of the foot and leg are obtained.

According to another embodiment, the winding device is mounted on the collar and the two braces are connected to a tension device pivoting on the spoiler.

BRIEF DESCRIPTION OF THE DRAWINGS

The invention will be better understood by relating the following description to the attached drawings which show a winding device according to the invention and several embodiments of its application to a ski boot.

DETAILED DESCRIPTION

Figure 1:
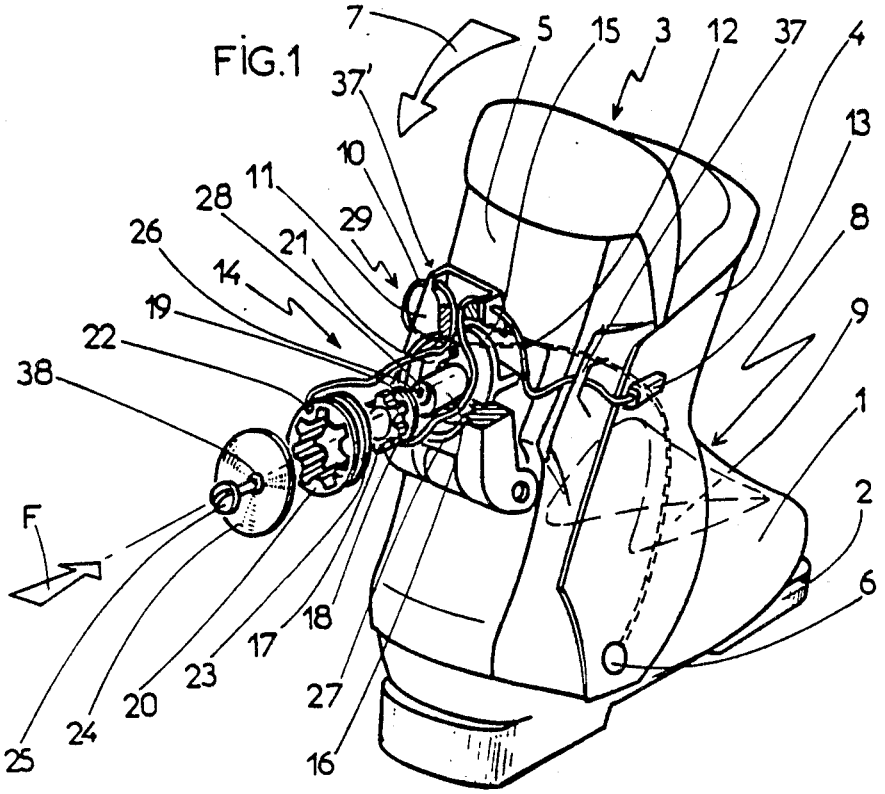
FIG. 1 is an enlarged view of a winding device according to the invention, mounted on the spoiler of a ski boot, and connected to a tension device.

The ski boot shown in FIG. 1 comprises, in a conventional manner, a rigid shell base 1 with sole 2 surmounted by a shank 3 formed by a front support 4 called "collar" and a rear support 5 called "spoiler"; in this example, collar 4 is attached with respect to shell base 1 while the spoiler 5 is articulated on the latter around the axis 6.

The introduction of the skier's foot is effected from the rear towards the front, after having pivoted the spoiler according to the arrow 7.

The skier's foot is held in the boot through the use of an internal foot support system 8 constituted, inter alia, of an anatomical plate 9 and a tension application cable 10 connected to shell base 1 at the level of axis 6 and through the use of a closure system 29 for the shank on the base of the leg, comprising a closure means 11 cooperating with a cable 12 connected to collar 4 by an anchoring component 13.

The two cables 10 and 12 are then attached by their other end to a winding device 14. In the case shown, cable 10 extends from winding device 14 to spoiler 5 through an opening 37' acting as a transmission element, which is not visible, but is identical and symmetrical to opening 37 provided for the passage of cable 12. It is next connected to collar 4 at a point of passage through it, into which it enters, being supported by said point of passage to extend along a trajectory which is more or less diagonal above foot support system 8 and is attached at the level of the axle 6. Due to this arrangement, any tension applied to cable 10 simultaneously causes the lowering of anatomical plate 9 on the foot and movement of spoiler 5 towards collar 4.

Cable 10 thus acts on the internal foot support system. However, the other cable 12 is also solicited to act at the level of the closing of the rod on the base of the leg through the intervention of the closure means 11 common to the two cables 10 and 12. Thus, with the aid of closure means 11 which allow cables 10 and 12 to be tightened simultaneously, foot support system 10 and the closing of shank 3 on the base of the leg are simultaneously controlled.

According to the invention, winding device 14 comprises:

- a control button 15 turnably mounted in this example on the closure means 11 and having an axle 16 which is offset with respect to the rotation axis of said button;
- a toothed pinion 17 pivoting on axle 16 and equipped with an anchoring device 18 for the engagement of the end of cable 12 as well as a groove 19 in which said cable 12 can be wound; and
- a toothed ring 20 turning in a corresponding housing 21 in the closure means 11, said ring having a number of teeth which is one greater than that of pinion 17 and an anchoring device 22 for the engagement of the end of cable 10 as well as a groove 23 in which said cable 10 can be wound. A cover 24 ensures the assembly of the constituent parts of the winding device through the use of the screw 25 which is screwed into a threaded hole 26 made in the end of axle 16. Advantageously, cover 24 fits into a housing 27 concentric with control button 15 while the end 28 of axle 16, also concentric to said button 15, engages in a corresponding hole 38 in said cover.

Figure 2:
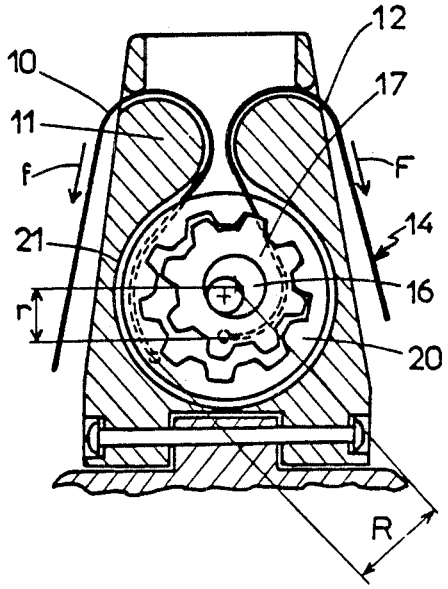
FIG. 2 is a longitudinal section view of the tension device shown in FIG. 1, in the direction of arrow F, showing a detail of the assembly of the winding device.
Figure 3:
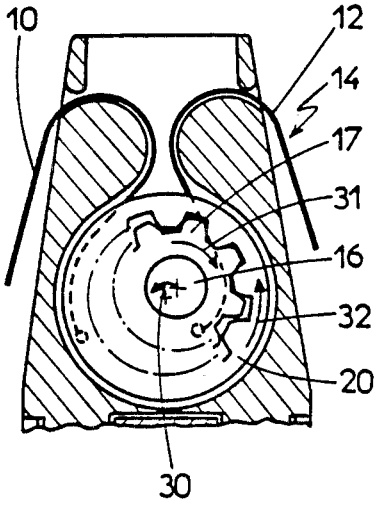
FIG. 3 is a schematic view of FIG. 2, representing the principle of operation of the winding device.

The winding device 14 thus constituted (FIGS. 1, 2 and 3) functions as a reducer. In fact, when control button 15 is turned, for example, in direction 30, off-center axle 16 is simultaneously pulled in the same direction as the latter, causing pinion 17 to turn inside ring 20, turning on itself in a direction 31, opposite that 30 of button 15. Ring 20 comprising a number of teeth one greater than that of pinion 17, for a turn of off-center axle 16, a delay of one tooth of said pinion 17 ensues with respect to the ring. In fact, the pinion 17 has turned on axle 16 by an angular distance of one tooth in the direction of the winding, i.e., in direction 31; cable 12 consequently is wound in groove 19 a corresponding angular distance.

To cause a turn of pinion 17 on itself, it is necessary to execute as many turns of control button 15 as pinion 17 has teeth and thus, the winding reduction in cable 12 will be inversely proportional to the number of teeth in said pinion. A further special characteristic of the winding device according to the invention resides in the fact that the ring 20 is free to rotate in housing 21 of closure means 11; as a result, when cable 12 is tightened, and thus resists the rotation of pinion 17 on itself, the latter pushes ring 20 back in a direction of rotation 32 identical to direction 30 of offset axle 16 and by an angular amount which is substantially equal to that of one tooth of said pinion for each turn of control button 15. Cable 10 thus, in turn, winds in groove 23 of ring 20. In the embodiment described above, winding grooves 19 and 23 respectively located on the pinion and the ring have different diameters, that of the pinion groove 19 being clearly smaller than that of the ring groove 23; thus, to obtain the equilibrium of forces at the level of the winding device, the cables will be under different tensions. In fact, when cable 12 transmits to pinion 17 a force which is equal to tension F, a moment is created which is equal to the product of this tension F with the radius r of the pinion winding groove 19; said moment being retransmitted to the level of the ring and having as its components a new tension f which is different from F, this time a factor of the radius R of the winding groove 23 of said ring. One will note that $F>f$ due to the equation of moments.

This constructional arrangement of the winding device allows one to act by a single movement of control button 15 on the successive winding of cable braces 10 and 12 as a function of the tensions exerted on each of them and on the differentiated winding lengths of the cables as a function of the different diameters of the winding grooves of each of them.

In addition, it appears that such a winding device can be partially reversed in the sense that the pinion and the ring can move relatively to each other by engagement when one of the braces (or cables) undergoes an increase in tension; in this case, the equilibrium of forces at the level of the winding device being broken by said cable, this tends to cause turning in the unwinding direction of the pinion or the ring on which it is engaged, pulling the other in the same direction. As a result, when one of the cables releases by a certain length, the other cable winds up by the same amount.

The winding device according to the invention thus makes it possible to automatically balance the lengths of the braces as a function of the tensions applied on either of them, without any action.

Figure 4:
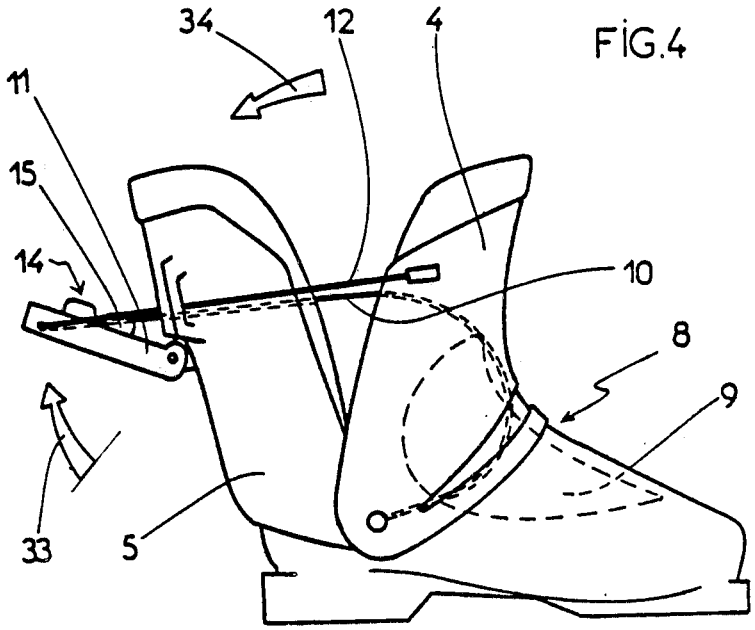
FIGS. 4 and 5 are elevation views of the ski boot of FIG. 1, respectively in open and closed positions.
Figure 5:
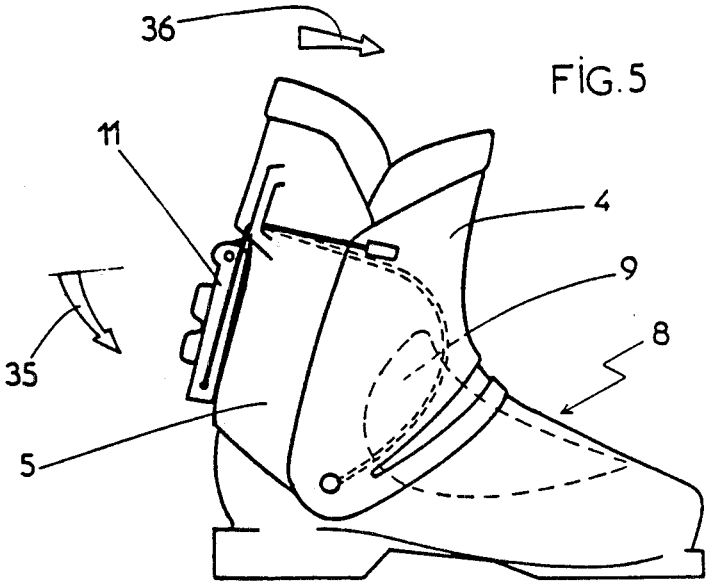

In FIGS. 4 and 5, the ski boot according to FIG. 1 is shown respectively in open and closed position. In FIG. 4, closure means 11 are unlocked in the direction of arrow 33 and the spoiler 5 is swung to the rear in the direction of arrow 34. The adjustment of the lengths of cables 10 and 12 by means of the winding device 14, which can be controlled by button 15 having been effected, as explained above, the boot is closed utilizing closure means 11, FIG. 5, which is brought against spoiler 5 in the direction of arrow 35. The tension caused on cables 10 and 12 then simultaneously causes the relative approach of spoiler 5 against collar 4 in the direction of arrow 36 and the lowering of anatomical plate 9 of internal support system 8 on the skier's foot.

Figure 6:
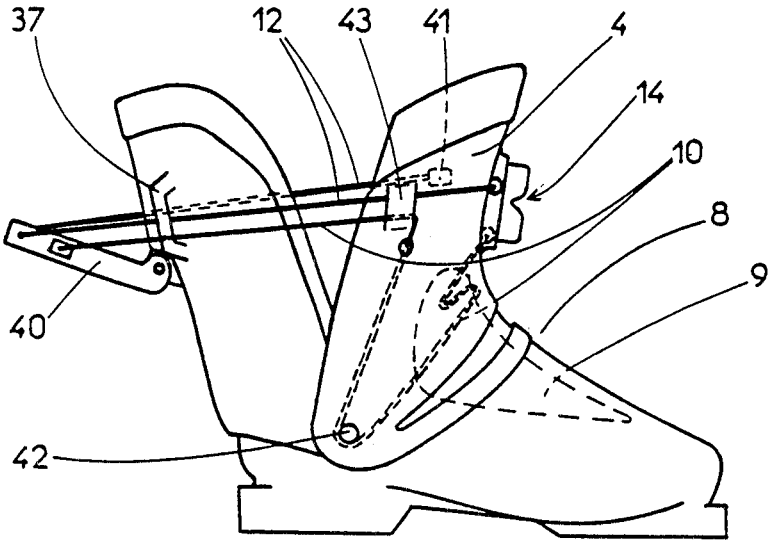
FIG. 6 is an elevation view of a ski boot equipped with a winding device conforming to the invention, mounted on the collar, and a tension lever placed on the spoiler.

Of course, the winding device 14 can be dissociated from the closure means 40 and mounted, as shown in FIG. 6, on collar 4 of the boot. Because each cable can have a different tension at the output of winding device 14, cable 12, which, in FIG. 2, engages on pinion 17 is then connected by a loop to a closure means 40 and next comes to be attached to collar 4 by an anchoring device 41.

Moreover, cable 10 is guided, in a manner which is known per se, through the wall of collar 4 and next extends above anatomical plate 9 of the foot support system, a transmission device 42 allowing it to be brought back to the level of the shank where a second transmission element 43 directs it towards closure means 40 with which it is engaged in a manner which can possibly be adjusted.

In this way, cable 12 which is subjected to the highest tension $F>f$ according to the above explanation, participates only in the closing of the shank on the base of the leg, and cable 10, having the least tension, participates in the support of the foot in the boot.

Figure 7:
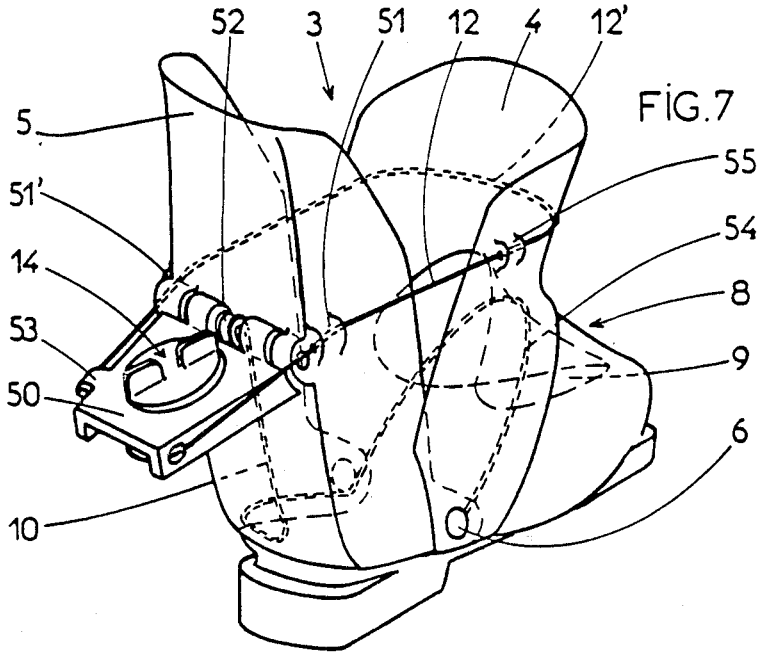
FIG. 7 is a perspective view of another embodiment of a ski boot equipped with a winding device according to the invention.

Finally, FIG. 7 illustrates, based on a closure means 50 equipped with a winding device 14 according to an assembly which is comparable to that of FIG. 1, that it is also possible to separate, still more distinctly, the functions of supporting the leg and of the internal support of the foot, by assigning, on the one hand, cable 12 only for the closing of shank 3, and, on the other hand, cable 10 only for internal foot support.

In the case in question, cable 12 is supported by closure means 50 when it leaves winding device 14, is next guided through a transmission element 51 arranged on spoiler 5 beyond which it extends towards collar 4 which it surrounds at least partially by a loop 12', the other bit of which is also directed through a transmission element 51' placed on the other side of spoiler 5, and is attached by an anchoring device 53 to closure means 50.

For reasons of esthetics and safety, loop 12' will be guided by keepers 55 placed on the upper periphery of said collar and at least partially covering the length of this loop, thus protecting it, for example, from possibly being hit directly by ski edges during skiing.

Cable 10, coming out of the winding device 14 opposite cable 12, is returned towards spoiler 5 on a return roller 52 which is advantageously coaxial with the articulation axis of closure means lever 50. Cable 10 is subsequently guided through the wall of the spoiler 5 and, in a loop 54, surrounds anatomical plate 9 of internal foot support system 8. The end of the loop 54 is anchored at the level of the pivoting axis 6 of the spoiler.

Different embodiments of a ski boot equipped with a winding device are within the scope of the invention described above; the application of tension to cables 10 and 12 was achieved utilizing a tension device 11, 40 and 50.

Figure 8:
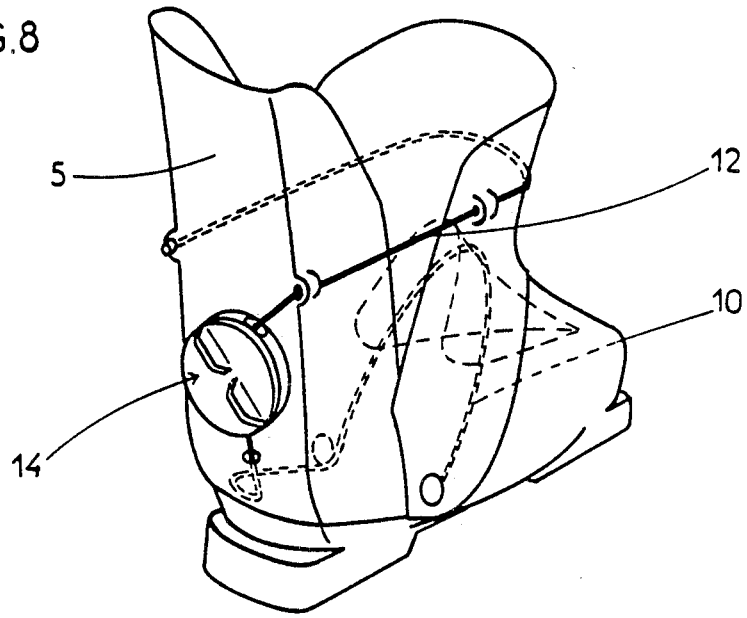
FIG. 8 is a perspective view of another embodiment of a ski boot, which also comprises a winding device according to the invention.

Obviously, the winding device according to the invention can also be employed as a single means of adjustment and tightening, without requiring the use of specific closure means. Such an application is illustrated in FIG. 8. In this case, winding device 14 is mounted, for example, on spoiler 5 and advantageously has two substantially opposite cable outlets as stated above for FIG. 7, such that each of cables 10 and 12 is respectively directed towards the leg base closure system and towards the internal foot support system.

Figure 9:
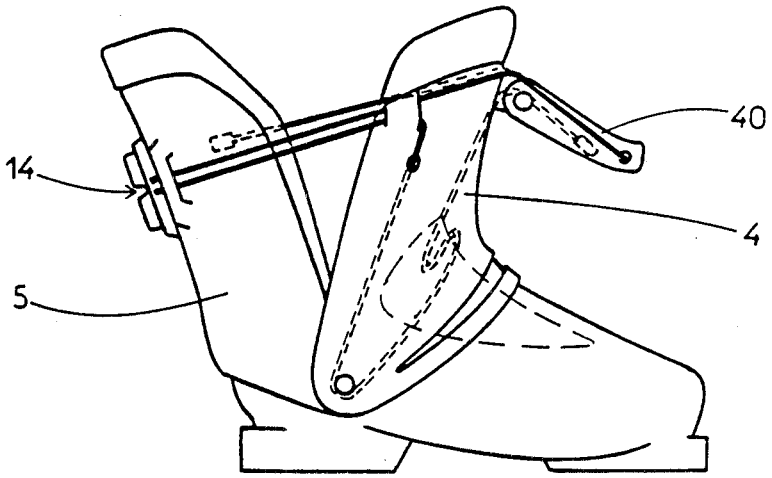

Finally, as shown in FIG. 9, contrary to FIG. 6, winding device 14 can be mounted on spoiler 5 while closure means 40 are placed on collar 4.

What is claimed is:

1. An alpine ski boot of the type which comprises:

(a) a shank having two rigid elements (4, 5), including a front element (4) and a rear element (5), at least one of said elements being articulated with respect to the other and with respect to a rigid shell base (1) in a lower zone of said shank (3) to allow movement between a relative open and closed position of said shank (3);

(b) an unlockable closure system for retaining said front and rear elements (4, 5) in a position of abutment against a leg of a skier and to enable their passage into open shank (3) position, said system comprising for this purpose a flexible brace (12) which is substantially inextensible in functional connection with at least a first of said elements (4, 5) of said shank (3) in an upper zone thereof and closure means (11, 37, 37'; 40, 37, 37'; 50, 51, 51') cooperating with said flexible brace (12) carried by the second of the elements (4, 5) of said shank;

(c) an internal foot support system (8) comprising another flexible brace (10) which is substantially inextensible in functional connection with an internal foot support element (9) and closure means (11, 37, 37'; 40, 37 37'; 50, 51, 51') cooperating with said flexible brake (10), carried by said second of said elements (4, 5) of said shank (3); and (d) means of adjustment for said unlockable closure and said internal foot support systems, said means being constituted by a double entry winding device (14) for each of said flexible braces (10, 12), said winding device comprising a helicoidal-type step-down wheel gear, in which an off-center device solid with a control button (15) carries a toothed pinion (17) which can turn inside a toothed ring (20), coaxial with said control button and equipped with a number of teeth which is one greater than that of the pinion (17), wherein said toothed ring is free to rotate with respect to a single fixed support solid with one of said rigid elements (4, 5) of said shank (3), while one of the braces (10, 12) cooperates with said winding groove (19) thanks to an anchoring device (18) carried by both the pinion (17) and said other brace (10) cooperates with the winding groove (23) thanks to an anchoring device (22) both carried by said toothed ring (20).

2. Ski boot according to claim 1, wherein said winding groove (19) carried by said pinion (17) has a diameter different from that (23) carried by said ring (20).

3. Ski boot according to claim 2, wherein said winding groove (19) carried by said pinion (17) has a diameter which is smaller than that (23) carried by said ring.

4. Ski boot according to claim 2, wherein said winding groove (19) carried by said pinion (17) has a diameter which is greater than that (23) carried by said ring (20).

5. Ski boot according to any one of claims 1 to 4, wherein said toothed ring (20) is free to rotate with respect to a fixed support constituted by said closure means (11, 50) provided with a corresponding housing.

6. Ski boot according to any one of claims 1 to 4, wherein said toothed ring (20) is free to rotate with respect to a fixed support constituted by said front element (4) of said shank (3) of said boot, said front element being provided with a corresponding housing.

7. Ski boot according to any one of claims 1 to 4, wherein said toothed ring (20) is free to rotate with respect to a fixed support constituted by said rear element (5) of said shank (3) of the boot, said rear element being provided with a corresponding housing.

8. Ski boot according to claim 1, wherein said winding device (14) comprises two brace entries facing in different directions.

9. Ski boot according to claim 1, wherein said flexible braces (10, 12) are constituted by potentially covered cables.

* * * * *